United States Patent [19]

Akutsu et al.

[11] Patent Number: 4,983,888

[45] Date of Patent: Jan. 8, 1991

[54] FLUORESCENT LAMP DEVICE

[75] Inventors: Hidezoh Akutsu, Kobe; Haruo Yamazaki, Moriyama, both of Japan

[73] Assignee: Matsushita Electronics Corporation, Osaka, Japan

[21] Appl. No.: 698,437

[22] Filed: Feb. 5, 1985

[30] Foreign Application Priority Data

Feb. 8, 1984 [JP] Japan ..... 59-22157

[51] Int. Cl.[5] ..... H05B 37/00

[52] U.S. Cl. ..... 315/242; 315/108; 315/110; 315/307; 315/DIG. 5

[58] Field of Search ..... 315/108, 110, 107, 63, 315/307, DIG. 5, 207, 112, 242; 313/547, 549, 550, 565, 566

[56] References Cited

U.S. PATENT DOCUMENTS

| | | | |
|---|---|---|---|
| 3,336,502 | 8/1967 | Gilliatt | 315/108 |
| 3,591,828 | 7/1971 | Washimi et al. | 315/108 |
| 3,714,492 | 1/1973 | Roche | 315/105 |
| 3,859,555 | 1/1975 | Latassa et al. | 313/490 |
| 4,005,332 | 1/1977 | Gallo et al. | 315/108 |
| 4,020,378 | 4/1977 | Morehead | 315/108 |
| 4,173,730 | 11/1979 | Young et al. | 315/53 |
| 4,268,780 | 5/1981 | Roche et al. | 315/179 |
| 4,337,418 | 6/1982 | Walz | 315/362 |
| 4,394,603 | 7/1983 | Widmayer | 315/307 |
| 4,438,374 | 3/1984 | Karius | 315/307 |
| 4,494,042 | 1/1985 | Roche | 315/63 |

FOREIGN PATENT DOCUMENTS

| | | | |
|---|---|---|---|
| 923497 | 2/1955 | Fed. Rep. of Germany . | |
| 1252801 | 10/1967 | Fed. Rep. of Germany . | |
| 1589137 | 3/1970 | Fed. Rep. of Germany . | |
| 1958974 | 6/1971 | Fed. Rep. of Germany | 313/490 |

*Primary Examiner*—Michael Razavi

*Attorney, Agent, or Firm*—Stevens, Davis, Miller & Mosher

[57] ABSTRACT

In a fluorescent lamp device, a discharge tube is made by arranging electrodes at the ends of a glass tube, sealing mercury and a rare gas into the glass tube and coating the inner surface of the glass tube with a phosphor, and an amalgam forming material is disposed close to one or the other of the ends of the discharge tube. This fluorescent lamp is operated with a d.c. current using as the anode the electrode arranged on the discharge tube end side where the amalgam forming material is located.

11 Claims, 3 Drawing Sheets

FLUORESCENT LAMP DEVICE

The present invention relates to a fluorescent lamp device.

Recently, various compact fluorescent lamp devices have been proposed for use as energy-saving light sources in place of incandescent lamps and some of them have already been put in practical use. An example of these lamp devices is constructed as follows. More specifically, disposed inside a lamp envelope is a discharge tube made by bending a long and slender glass tube into a double U-shape, and a case with a base is attached to the open end of the lamp envelope. The discharge tube has an electrode at each of its ends and its inner surface has a phosphor coating. Mercury and rare gas are put into the discharge tube. Also, in order to control the increase in the mercury vapor pressure due to marked rise of the tube temperature during its operation, the discharge tube employs an amalgam forming metallic material such as In, BiIn or BiPbSn, which is placed in a stem tube at either of the tube ends. Also, disposed inside the case are a choke coil type ballast and a glow starter.

In this type of fluorescent lamp device, the metallic material forms an amalgam with filling-in mercury. The mercury vapor pressure over the amalgam is lower than that of the pure mercury. Therefore, ever if the tube temperature rises so high up to around 100° C., the mercury vapor pressure in the tube can be adjusted within an optimum range for luminous efficacy of the discharge tube, e.g., around $6\times10^{-3}$ Torr.

Accordingly, the compact fluorescent lamp device of this type shows a high overall efficacy of more than 40 lm/W almost comparable to three times that of an incandescent lamp. Furthermore, it is convenient in that it can be used by simply screwing as such into an incandescent lamp socket.

However, there still exist some drawbacks to be overcome before this compact fluorescent lamp device is developed into one of main light sources. The first drawback is that the weight of the fluorescent lamp device is more than 400 g, which is substantially heavier as compared with the incandescent lamp. This is due to the fact that the weight of the choke coil ballast is as large as about 250 g. The fact that the weight of the fluorescent lamp device is large prevents it from coming into wide use on a full scale.

It is conceivable to replace the choke coil with a light resistor or electronic circuit for the ballast as a means of reducing the weight of the lamp device. However, the use of the former resistor gives rise to a problem that the loss of the ballast is increased and the overall efficacy of the lamp device is decreased.

The second drawback is that, when particularly the lamp is operated at low ambient temperatures ranging from 0° to 10° C., it shows light flickering for several minutes just after lamp ignition. This is a phenomenon which markedly occurs in the lamps using a discharge tube made by bending a slender tube. The flicker phenomenon is caused by the fact that when the lamp is operated with ordinary ac current, the time required for the discharge to re-ignite differs from one cycle to another and thus the discharge current is varied with cycles.

It is an object of the present invention to provide a fluorescent lamp device which is light in weight and moreover almost equal or even superior equal in overall efficacy to conventional lamp devices using the choke coil ballast.

It is another object of the invention to provide a fluorescent lamp device having no flicker of light.

The inventors have made studies to obtain a fluorescent lamp device which would accomplish the above-mentioned objects. This has led to a basic concept; operation of the discharge tube with dc current. Namely, if the slender-tube discharge tube is operated with ac current, the re-ignition voltage for each half cycle is increased with the result that it is difficult to increase the lamp voltage of the discharge tube and the voltage drop across the ballast is increased correspondingly Thus, the ballast loss is increased and the ballast is increased in size and weight. On the other hand, if the discharge tube is operated with dc current, basically the re-ignition voltage is no longer present with the result that the ratio of the lamp voltage to the power supply voltage is increased and the ballast loss is decreased correspondingly thus reducing the size and weight of the ballast. Also, the dc operation can completely prevent the occurrence of flicker of the light.

Realization of the above-mentioned basic concept requires a discharge tube that can be operated with dc current. In this concern, it has been well known that if ordinary fluorescent lamps are operated with dc current, the so-called cataphoresis phenomenon occurs; mercury tends to move from the anode region toward the cathode region and therefore a bright luminous area is present only in the discharge tube portion near the cathode while causing the near-by portion of the anode to darken.

As a next step, the inventors have made various studies to obtain a discharge tube and an operating device which show no cataphoresis phenomenon even in dc operation. It has been discovered that the occurrence of the cataphoresis phenomenon can be suppressed by disposing an amalgam material in the vicinity of either one of the discharge tube ends, then setting up the electrode near to the amalgam as the anode and operating the discharge tube with dc current. By virtue of this new discovery, a fluorescent lamp device has been realized which is operable with dc current, has a light ballast and has no flicker of light.

Studies have been made on the design factors of a discharge tube which determine the overall efficacy of a fluorescent lamp device operated with dc current by the above-mentioned method. It has been found that if a lamp voltage $V_L$ (dc rms value) in the dc operation is held in a range of $0.65\ V_S \leqq V_L \leqq 0.90\ V_S$ with respect to a supply voltage $V_S$ (ac rms value), the overall efficacy of the lamp operated even on a resistor ballast is on almost the same level with the conventional fluorescent lamp device employing a choke coil-type ballast.

The present invention will be apparent from the following detailed description taken in conjunction with the accompanying drawings, in which.

Figure 1:
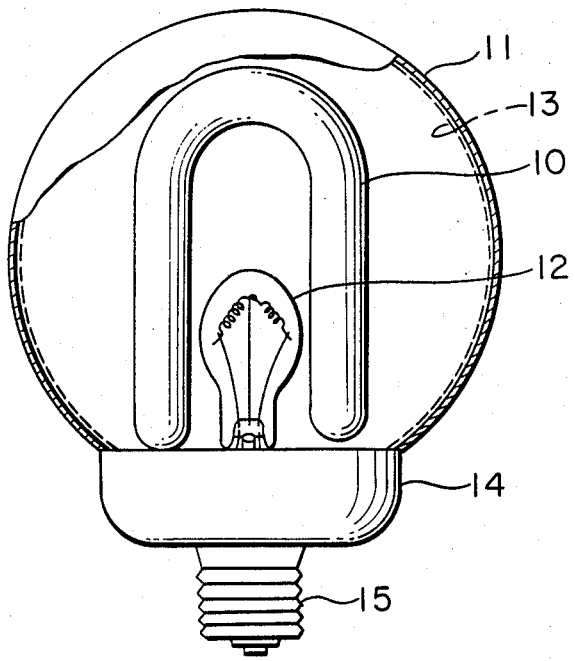
FIG. 1 is a partially cutaway front view of a fluorescent lamp device according to an emboidment of the invention.

In FIG. 1 illustrating a compact fluorescent lamp device, a discharge tube 10 made by bending a long and slender glass tube into a double U-shape is held in place within a lamp envelope 11. Also, disposed inside the lamp envelope 11 is a resistance ballast 12 including an electric lamp having a tungsten filament placed within a glass tube. A white diffusing coating 13 is formed on the inner surface of the lamp envelope 11. A case 14 is attached to the open end of the lamp envelope 11. Then, excluding the resistance ballast 12, the other lamp circuit components which will be described later are all contained within the case 14. An incandescent lamp base 15 is attached to the bottom of the case 14.

Figure 2:
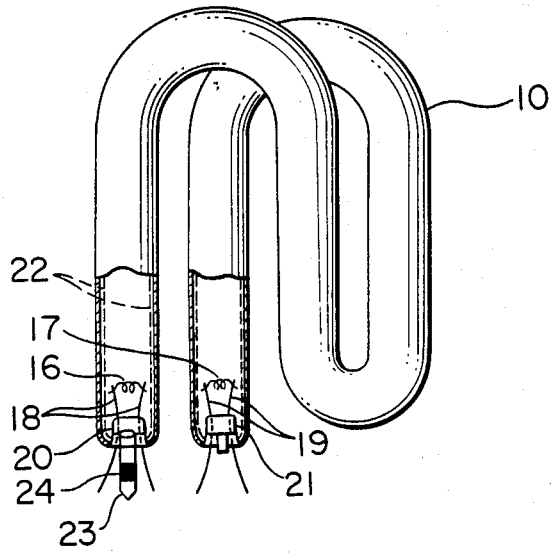
FIG. 2 is a partially cutaway perspective view showing an example of the discharge tube used in the fluorescent lamp device of FIG. 1.

FIG. 2 shows the construction of the discharge tube 10. In the Figure, at the ends of the discharge tube 10 electrodes 16 and 17 are respectively held in place by lead wires 18 and 19 and stems 20 and 21 and the discharge tube 10 is coated on the inner surface with a phosphor 22. Also, mercury and rare gas, e.g., argon are put into the discharge tube 10. In addition, for the purpose of controlling the mercury vapor pressure, an amalgam forming metallic material 24, e.g., In, BiIn or BiPbSn is placed inside a small glass tube 23 at the rear of one of the stems, i.e., the stem 20. When the lamp is operated, the metallic material 24 forms amalgam with mercury.

Figure 3:
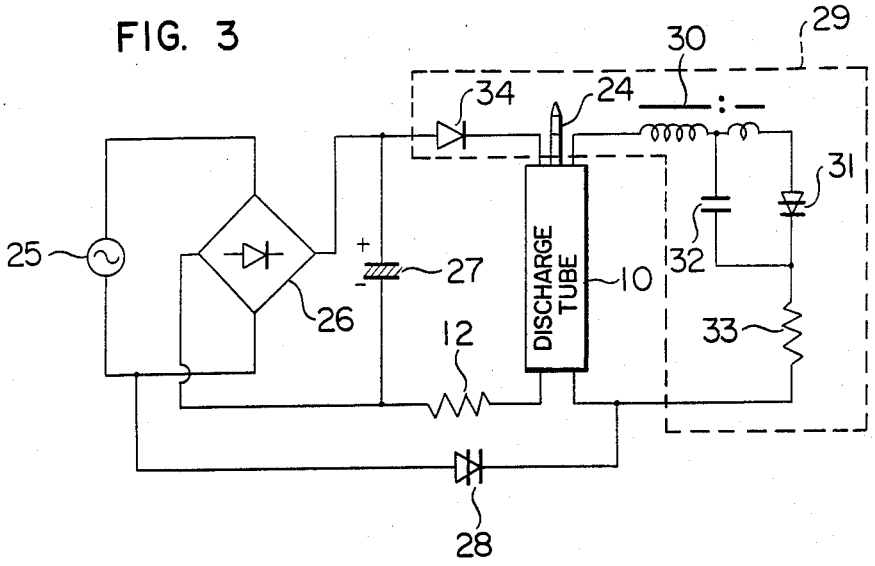
FIG. 3 is a circuit diagram for the lamp circuit of the fluorescent lamp device of FIG. 1.

FIG. 3 shows the operating circuit of the fluorescent lamp device described above. In the Figure, numeral 25 designates an ac power source, 26 a full-wave bridge rectifier, and 27 a smoothing capacitor. The ac power is converted to dc power by the full-wave bridge rectifier 26 and the smoothing capacitor 27. Numeral 28 designates a thyristor (PnPn diode) which functions to supply a preheating current to the electrode coil (the cathode) during the lamp starting period. Numeral 29 designates an electronic starter including a pulse transformer 30, a thyristor 31 (PnPn diode), a capacitor 32, a resistor 33 and a diode 34.

When the discharge tube 10 shown in FIG. 11 is first operated by the above-described circuit using as the cathode the electrode 16 arranged close to the amalgam material 24, the occurrence of a cataphoresesis phenomenon in a short period of time is observed. In this case, the cataphoresis phenomenon becomes more marked as the ambient temperature decreases. For instance, in the ambient temperature of 0° to 10° C., the cataphoresis phenomenon occurs in several minutes after lamp ignition and moreover the cataphoresis phenomenon is so eminent that the light output is made dim over the portions amounting to more than ¾ of the whole area of the discharge tube 10.

Then, when the polarity of the power source is reversed and the discharge tube 10 is operated using as the anode the electrode 16 arranged on the end side of the discharge tube 10 where the amalgam material 24 is provided, it is seen that the occurrence of the cataphoresis phenomenon is practically suppressed. The results of the observation made by the inventors have shown that a uniform light-output distribution is obtained all over the discharge tube 10 even if the ambient temperature is around 0° C. In view of the results of the studies made by the inventors on the mechanism of this new phenomenon, the mercury moves as ions away from the anode region toward the cathode region due to electrophoresis. In contrast, the presence of the amalgam material 24 on the anode side has the effect of causing a diffusion phenomenon of the mercury from the cathode region to the anode region due to the mercury vapor pressure difference (being higher in the cathode side than in the anode). Accordingly, it is considered that the movement of the mercury from the anode region to the cathode region due to electrophoresis is cancelled by the movement of the mercury in the opposite direction due to the diffusion phenomenon provided by the amalgam.

Now, when the discharge tube 10 is operated using as the cathode the electrode 16 arranged on the discharge tube end side where the amalgam material 24 is present as mentioned previously, the mercury is moved from the anode region toward the cathode region due to both electrophoresis diffusion phenomena; so it is considered that the cataphoresis phenomenon is seriously promoted.

Then, the inventors have made studies on how to bring the overall efficacy of the dc operated fluorescent lamp device employing a resistance ballast up to the same level as that of the conventional fluorescent lamp device employing a choke ballast. Various discharge tubes having different tube outside diameters d and interelectrode distances l have been made for trial as the discharge tube 10 as shown in the following Table 1 and their characteristics have been measured and analyzed by using the operating circuit of FIG. 3.

TABLE 1

| Tube outer diameter d (mm) | Interelectrode distance l (mm) | | | |
|---|---|---|---|---|
| 14.0 | 290 | 330 | 360 | |
| 15.5 | 300 | 340 | 370 | 400 |
| 17.0 | 310 | 350 | 380 | 410 |
| | (Ar 3.5 Torr sealed) | | | |

The results have shown the following.

Figure 4:
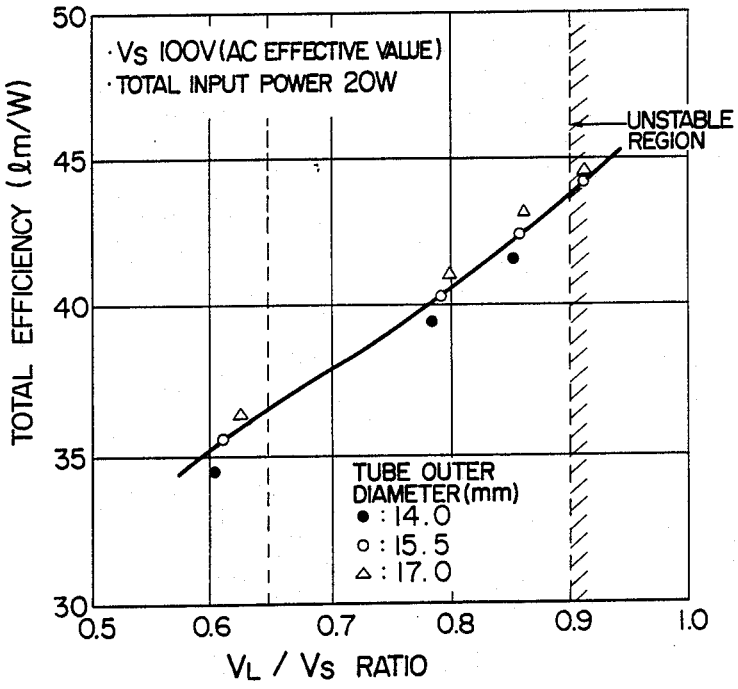
FIG. 4 is a graph showing the relation between the $V_L/V_S$ ratio and the overall efficacy.

(1) The overall efficacy of the lamp device is mainly dependent on the ratio of the lamp voltage $V_L$ (dc rms value) to the supply voltage $V_S$ (ac rms value) as shown in FIG. 4 and the overall efficacy is not substantially dependent on the outer diameter d of the discharge tube so far as the value of $V_L/V_S$ is the same. Here, the value of $V_L/V_S$ also represents the ratio of the lamp wattage to the total input power; so it is said that the overall efficacy of the fluorescent lamp according to the invention is increased with an increase in the ratio of the lamp wattage to the total input power. Now, in order to attain an overall efficiency higher than the minimum value of 35 lm/W attained by the conventional choke coil type, the lamp voltage $V_L$ must be determined to be a range of $V_L \geqq 0.65\ V_S$ in view of the variations in charactersitics among different lamps. Then, it can be said that the lamp voltage $V_L$ is mainly dependent on the interelectrode distance l of the discharge tube and thus indirectly the overall efficacy is increased with an increase in the interelectrode distance l.

(2) While the overall efficacy is increased with increase in the value of $V_L/V_S$ as mentioned in the above (1), an excessive increase in the value of $V_L/V_S$ gives rise to some problems. One is the fact that when the value of $V_L/V_S$ is increased, there are cases where the discharge arc is not stabilized for several minutes just after its ignition with the resulting flicker of the light. The reason is not clear as yet. Also, the increased value of $V_L/V_S$ causes the fluctuation of the total input power and the lamp current to increase with variation of the supply voltage. The results of the studies by the inventors have shown that if the value of $V_L$ is determined to fall within a range of $V_L \leqq 0.90\ V_S$, the above-mentioned flicker of light can be practically suppressed and also this range of values maintains the fluctuation of the total input power with variation of the supply voltage on the same level as the conventional choke coil-type lamp device (the fluctuation of the total input power is about 30% or less against 10% variation of $V_S$).

From the results of (1) and (2)above, it has become clear that in order to enhance the overall efficacy up to the same level as the conventional choke coil type and maintain the supply voltage variation characteristics, etc., within the practical tolerance limits, it is necessary to select the lamp voltage $V_L$ to fall within the range of $0.65\ V_S \leqq V_L \leqq 0.90\ V_S$. Here, it is noted that the fact that basically the lamp efficacy itself is increased as compared with the conventional choke coil type is greatly contributing to the attainment of the above-mentioned relatively high overall efficacy despite the resistance ballast-type device. Such increase in the lamp efficacy is based on the following two reasons: (1) the dc operation itself increases the lamp efficacy by about 10% as compared with the ac operation. (2) The dc operation permits the setting of the lamp voltage $V_L$ to a higher value and hence the operation of the discharge tube having an increased tube length with a reduced lamp current.

The following Table 2 shows the specifications and characteristics of the compact fluorescent lamp device constructed as shown in FIG. 1 in comparison with the conventional device.

TABLE 2

| | Embodiment device | Conventional device |
|---|---|---|
| Lamp envelope: | | |
| diameter | 104 mm | 104 mm |
| height | 95 mm | 95 mm |
| Discharge tube outer diameter | 15.5 mm | 15.5 mm |
| Interelectrode distance | about 340 mm | about 250 mm |
| Phosphor (mixture) | $CeMgAl_{11}O_{19}$: Tb (green) $Y_2O_3$: Eu (red) | " |
| Sealed rare gas | Ar 3.5 Torr | Ar 3.5 Torr |
| Amalgam metal | BiIn alloy | None |
| Operation system | dc operation resistance ballast | ac operation choke coil ballast |
| AC supply voltage | 100 V | 100 V |
| Total input power | 20 W | 18.0 W |
| Lamp wattage | 12 W | 13.5 W |
| Lamp voltage | 79 V | 54 V |
| Lamp current | 152 mA | 310 mA |
| Luminous flux | 806 lm | 710 lm |
| Overall efficacy | 40.3 lm/W | 39.4 lm/W |
| Device weight | about 200 g | about 440 g |

As shown in Table 2, the overall efficacy of the embodiment device of this invention attains a level of about 40 lm/W and the weight is also reduced to about one half that of the conventional device. Also, in accordance with the invention the flicker of light is eliminated.

Figure 5:
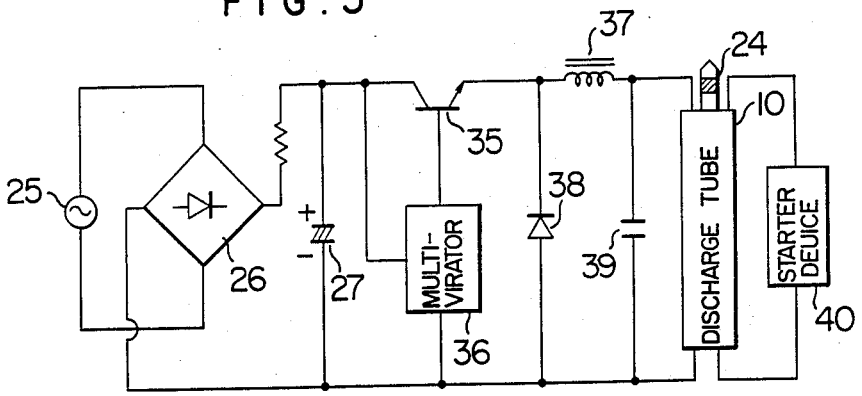
FIG. 5 is a circuit diagram for the lamp circuit of the fluorescent lamp device according to another embodiment of the present invention.
Figure 6:
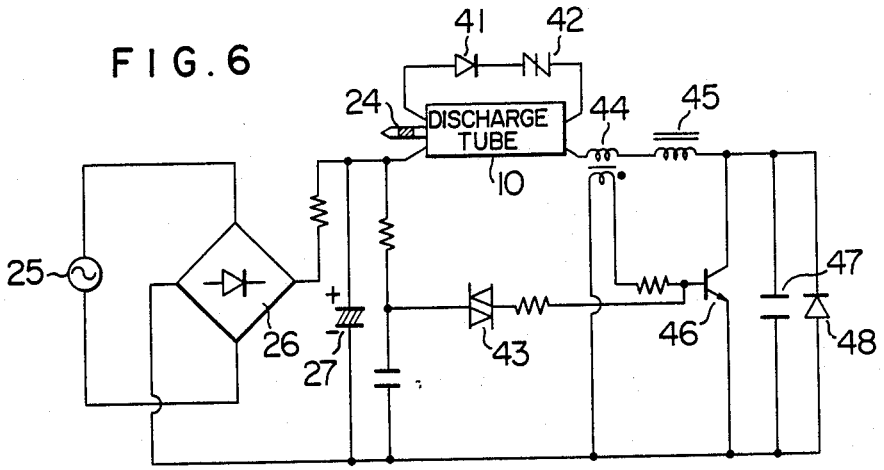
FIG. 6 is a circuit diagram for the lamp circuit of the fluorescent lamp device according to still another embodiment of the present invention.

The present invention is not intended to be limited to the operation on the resistor ballast; its basic concept is applicable to electronic ballast systems characterized by a compact and light construction and no light flickering as well. In this respect, present-day commercial electronic ballasts for fluorescent lamps which employ ac high-frequency operating systems such as push-pull type and blocking type inverters have only one drawback of high cost. On the other hand, the present invention offers chopping type electronic operating systems having a simple circuitry and therefore a lower price as compared with the above ac high-frequency systems. FIGS. 5 and 6 illustrate typical circuits of chopping type ballasts. The circuit in FIG. 5 uses a dc chopping system in which the discharge tube is operated with almost smoothed dc current. In accordance with the present invention, the electrode near the amalgam material should be taken as the anode. In FIG. 5, numeral 35 desginates a power transistor, 36 a control circuit including a multivibrator, 37 a choke coil, 38 a diode, 39 a capacitor, and 40 a starter device including a glow starter.

Figure 7:
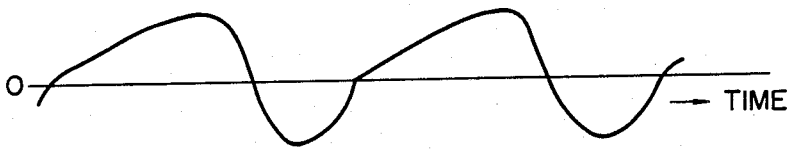
FIG. 7 is a waveform diagram of a discharge current flowing into a discharge tube used in the lamp circuit of FIG. 6.

The circuit in FIG. 6 is an ac chopping operating system in which the discharge tube is operated with asymmetric ac current having some dc component as shown in FIG. 7. Here, it is also noted is that, in order to prevent the cataphoresis phenomenon in the operating discharge tube, the electrode near the amalgam material must be taken as the anode for the dc current component. In FIG. 6, numeral 41 designates a diode, 42 a bidirectional two-terminal thyristor (SSS), 43 a bidirectional two-terminal thyristor ("DIAC"), 44 a current detection transformer, 45 a choke coil, 46 a power transistor, 47 a capacitor, 48 a diode. Both fluorescent lamp devices employing the above chopping type operating systems present a higher overall efficacy of around 50 lm/W than that of the previously mentioned device having the resistor ballast, because of extremely reduced power loss of the electronic ballasts. In addition, the chopping type operating circuit features a simple design of one power transistor type and no power transformer, therefore being relatively less costly as compared with the conventional ac high-frequency inverter circuits.

Also the present invention is not intended to be limited to the bent-type compact fluorescent lamp device and it is also applicable to fluorescent lamps of the other types such as the tubular and circ-line types. For instance, the studies by the inventors have confirmed that the invention is applicable to such tubular-type copier fluorescent lamps operated under high load conditions. Further, the present invention is basically applicable to devices in which the supply voltage $V_S$ is not 100 V. For example, in accordance with the invention a compact fluorescent lamp device operable at a supply voltage $V_S$ of 120V has been manufactured for trial and it has been confirmed that its overall efficacy is substantially the same level as the devices of the type whose supply voltage $V_S$ is 100V.

Further, in FIG. 2, the mounting position of the amalgam material 24 is not always limited to the rear of the electrode and what is important is the fact that it is positioned close to the electrode which functions as the anode. Also, in the fluorescent lamp device of the invention, the discharge tube and the lamp circuit section need not be combined as a unit and the object of the invention, i.e., a fluorescent lamp device which is light in weight and relatively high in overall efficacy can still be realized even if the two are separately mounted in a luminair, for example.

We claim:

1. A fluorescent lamp device comprising:

a discharge tube coated on an inner surface thereof with a phosphor, having at least mercury sealed therein and including an anode electrode and a cathode electrode;

a direct-current circuit connected to said discharge tube for operating said discharge tube; and an amalgam forming material arranged close to said anode electrode of said discharge tube, said direct current circuit including a positive pole connected to said anode electrode, said amalgam forming material forming an amalgam with said mercury in said discharge tube in response to operation of said discharge tube.

2. A. device according to claim 1, wherein said amalgam forming material is contained in an exhaust tube provided near said anode electrode of said discharge tube.

3. A device according to claim 1, wherein said direct-current circuit includes a rectifier circuit for converting an alternating-current power to a direct current one and a ballast.

4. A device according to claim 3, wherein said ballast comprises a resistor.

5. A device according to claim 4, wherein said resistance ballast comprises an electric bulb having a filament coil.

6. A device according to claim 3, wherein said ballast comprises dc chopping type electronic circuit system.

7. A fluorescent lamp device comprising:

a discharge tube coated on an inner surface thereof with a phorphor, having at least mercury sealed therein and including an anode electrode and a cathode electrode;

an amalgam forming material contained within an exhaust tube disposed close to said anode electrode of said discharge tube;

an alternating-current power source;

a direct-current circuit for converting an a.c. power from said power source to a d.c. power and supplying said d.c. voltage to said discharge tube to operate the same, said direct-current circuit including a resistance ballast and having a positive terminal connected to said anode electrode arranged within said discharge tube, said anode electrode being positioned close to said amalgam forming material;

enclosure means for accommodating said discharge tube and said direct-current circuit; and connector means attached to said enclosure means for connecting said direct-current circuit to said power source.

8. A device according to claim 7, wherein said resistance ballast comprises an electric bulb having a filament.

9. A fluorescent lamp device comprising:

a discharge tube coated on an inner surface thereof with a phosphor, having at least mercury sealed therein and including two electrodes;

an amalgam forming material arranged close to one or the other of two electrodes of said discharge tube, characterized by that;

said discharge tube is operated with asymmetric alternative current having some dc component in such a manner that said one electrode being positioned close to said amalgam material is employed as anode for said dc component.

10. A device according to claim 8, wherein said discharge tube is operated on ac chopping type operating circuit with asymmetric alternative current.

11. A device according to claim 1, wherein said amalgam forming material is selected from the group consisting of In, BiIn and BiPbSu.

* * * * *